US005493982A

United States Patent [19]

Carpenter et al.

[11] Patent Number: 5,493,982

[45] Date of Patent: Feb. 27, 1996

[54] KAYAK HAVING IMPROVED THIGHSTRAP ASSEMBLY

[75] Inventors: William A. Carpenter, West Union, S.C.; Joseph A. Galea, Gloversville, N.Y.; Robert J. McDonough, Easley, S.C.

[73] Assignee: Perception, Inc., Easley, S.C.

[21] Appl. No.: 371,409

[22] Filed: Jan. 11, 1995

[51] Int. Cl.[6] ..... B63B 35/00

[52] U.S. Cl. ..... 114/347

[58] Field of Search ..... 114/347, 213, 114/215

[56] References Cited

U.S. PATENT DOCUMENTS 2,878,013 3/1959 Piodi ..... 114/213

5,083,522 1/1992 Ashrow ..... 114/215

5,189,974 3/1993 Masters ..... 114/347

5,257,590 11/1993 Foote, Jr. et al. ..... 114/347

*Primary Examiner*—Stephen Avila

*Attorney, Agent, or Firm*—Dority & Manning

[57] ABSTRACT

A open cockpit kayak is provided including an improved thighstrap arrangement. The arrangement includes left and right thighstraps situated on respective sides of the cockpit area and extending in the longitudinal direction of the hull. Opposite ends of each thighstrap are movably connected to the hull at respective fore and aft connection locations. Each of the thighstraps includes an elastic element to maintain it in tension between the respective fore and aft connection locations. As a result, the thighstraps will generally remain taut against the hull when not in use. Further, the thighstraps will remain in engagement with a paddler's knees during use so that the paddler may easily achieve positive control of the kayak.

17 Claims, 3 Drawing Sheets

KAYAK HAVING IMPROVED THIGHSTRAP ASSEMBLY

BACKGROUND OF THE INVENTION

The present invention relates generally to the art of kayaks such as may be used for whitewater rafting. More particularly, the invention relates to such a kayak which includes an improved thighstrap assembly.

Kayaks of the type utilized for whitewater rafting are typically constructed to have a closed cockpit during use. In this traditional design, the paddler enters the cockpit through an opening in the top of the hull and sits on a seat located in the cockpit. The paddler's legs typically extend forward from the seat into a hollow region of the hull and engage various thighbraces situated therein. The opening in the top of the hull through which the paddler's torso extends includes a coaming to which a spray skirt may be attached. As a result of this design, the paddler is very securely situated with respect to the kayak during use. Thus, effective point-of-contact control is immediately provided if the paddler desires to manipulate the kayak in an aggressive manner.

Another type of kayak, i.e., an open cockpit kayak, does not have this traditional arrangement to provide point-of-contact control. In this design, the entire cockpit is formed by a depression defined in the top surface of the hull. To maintain the paddler in position in an open cockpit kayak, a variety of padded seats and thighstrap arrangements have been utilized. As will be discussed herein, one prior design utilized a pair of longitudinally extending thighstraps located on each side of the open cockpit.

This thighstrap arrangement and others of the prior art have generally fallen short of optimum performance in at least two ways. First, when the paddler is sitting in a relaxed position and paddling easily, the paddler's knees are often simply in touch with the straps. In other words, minimal support and control are provided for the paddler's knees in this situation. If aggressive manipulation of the kayak is desired, the paddler's knees must first be tightened against the thighstrap to eliminate any slack (usually a few inches). When the slack is eliminated, positive control of the kayak may be achieved.

Second, prior art thighstraps have tended to dangle loosely when not in position about the knees of a paddler. Occasionally, however, a kayak will capsize when proceeding through turbulent water. Loosely dangling thighstraps can often be undesirable when the kayak is capsized, particularly on rivers where submerged obstacles are common.

SUMMARY OF THE INVENTION

The present invention recognizes and addresses the foregoing disadvantages, and others, of prior art constructions and methods. Accordingly, it is a principal object of the present invention to provide an improved kayak.

It is a more particular object of the present invention to provide a novel kayak incorporating an improved thighstrap assembly.

It is a further object of the present invention to provide an improved open cockpit kayak which generally facilitates greater control thereof by a paddler than other open cockpit kayaks.

It is a further object of the present invention to provide an improved open cockpit kayak which generally does not have loosely dangling thighstraps.

It is also an object of the present invention to provide an improved thighstrap assembly for use with an open cockpit kayak.

Some of these objects are achieved by a kayak comprising a hull extending in a longitudinal direction. The hull includes a fore portion and an aft portion and defines a boat bottom. The hull further defines a cockpit area configured to receive a paddler in a sitting position. The cockpit area is located between the fore portion and the aft portion of the hull.

The kayak includes left and right thighstraps located along respective left and right side portions of the cockpit area and extending in the longitudinal direction of the hull. Opposite ends of each thighstrap are movably connected to the hull at respective fore and aft connection locations. Each thighstrap includes an elastic element to maintain tension therein between the fore and aft connection locations. As a result, each thighstrap will generally remain taut against said hull when not is use and further apply tension to the paddler's knee when in use.

Other objects of the invention are achieved by a kayak thighstrap assembly comprising a thigh engaging element, such as an elongated pad, having a first end and a second end. The assembly further includes a first strap constructed of elongated strap material. The first strap has an attached portion attached to the thigh engaging element and further has a free portion longitudinally extending from the first end of the thigh engaging element.

First and second hooking elements are provided for connecting respective ends of said thigh strap assembly to a hull of a kayak. The first hooking element is connected to the free portion of said first strap. Similarly, the second hooking element is connected to the free portion of the second strap.

In some presently preferred embodiments, the elastic element of each thighstrap assembly includes an elastic cord. In this regard, the elastic element may include at least two elastic cord segments extending substantially in parallel. In some exemplary constructions, a single elastic cord may be threaded through a loop in the first strap portion. Two parallel segments may then be formed by extending portions of the single elastic cord substantially in parallel back to the location of connection to the second strap portion. The elastic cord may be connected to the second strap portion by being knotted behind an eyelet defined in the second strap portion.

One guide or guide elements may be attached to the thigh engaging element through which the second strap extends. The guide element will function to guide the second strap during longitudinal movement thereof. Additionally, the second strap portion may be connected to the first strap portion via a two-ring buckle such that a length of the second strap portion may be adjusted. A second strap is also provided constructed of elongated strap material. The second strap has a secured portion operatively secured at a location on said thigh engaging element and further has a free portion longitudinally extending from the second end of the thigh engaging element. The assembly includes an elastic element connected to the second strap to apply a force thereto tending to bias the second strap against longitudinal extension thereof.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
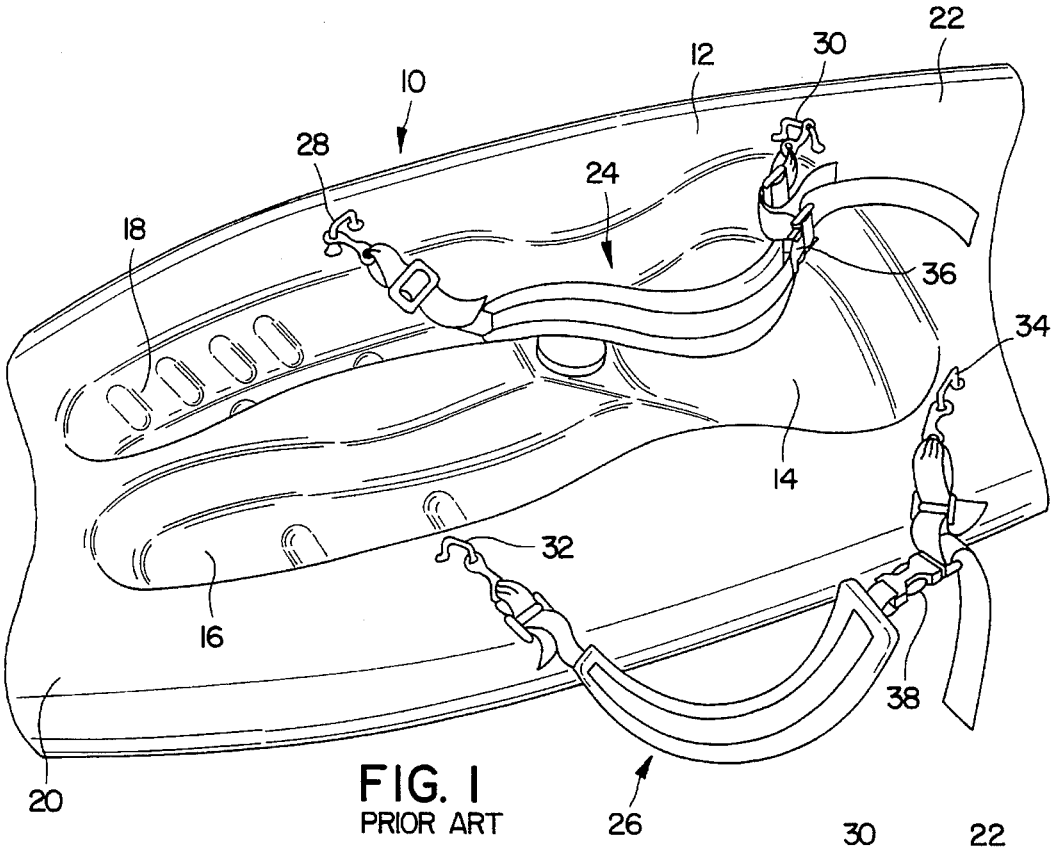
FIG. 1 PRIOR ART
FIG. 1 is a perspective view of a portion of an open cockpit kayak equipped with a thighstrap arrangement of the prior art.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Although the prior art has been described generally above, the present invention may be most easily explained if prior art teachings are discussed in greater detail. Thus, FIG. 1 illustrates a prior art kayak 10 of a type which may be improved according to the present invention. As shown, kayak 10 includes a hull 12 defining a running surface along its bottom. On its top, hull 12 defines a depressed area which serves as an open cockpit. The open cockpit includes a seat portion 14 and a pair of leg receiving areas respectively indicated at 16 and 18. As can be seen, the open cockpit area is situated between a fore portion 20 and an aft portion 22 of hull 12.

Kayak 10 is further equipped with a pair of thighstraps generally indicated at 24 and 26. As shown, thighstrap 24 extends between locations 28 and 30 along the right side of the cockpit. Similarly, thighstrap 26 extends between locations 32 and 34 along the left side of the cockpit.

As shown, thighstraps 24 and 26 include respective quick-release connectors 36 and 38. Generally, the interlocking portions of connectors 36 and 38 are disengaged when a paddler wishes to enter or exit the cockpit of kayak 10. The interlocking portions of connectors 36 and 38 are engaged during use, with thighstraps 24 and 26 extending around the paddler's knees.

The length of thighstrap 24 is greater than the shortest distance between connection locations 28 and 30. Similarly, the length of thighstrap 26 is greater than the shortest distance between locations and 32 and 34. This relative looseness defines a space between hull 12 and thighstraps 24 and 26 to accommodate the width of the paddler's respective knee.

Because of their construction, thighstraps 24 and 26 tend to hang loosely from hull 12 when not in use. As noted above, however, this looseness has the disadvantage of allowing thighstraps 24 and 26 to dangle, which may be particularly undesirable when kayak 10 is capsized. Additionally, this looseness often results in a delay in achieving positive control of kayak 10 when the paddler wishes to make an aggressive movement.

Figure 2:
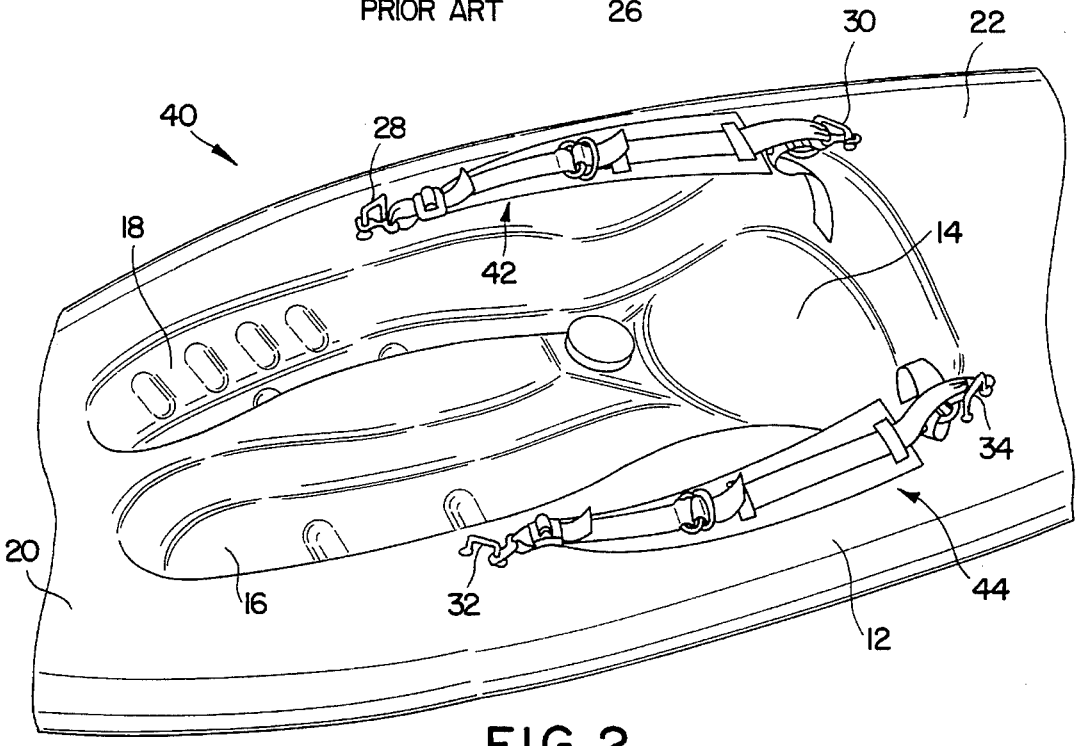
FIG. 2 is a view similar to FIG. 1 of an open cockpit kayak equipped with a thighstrap assembly of the present invention.

Referring now to FIG. 2, the present invention provides an improved kayak 40 which overcomes the noted problems of the prior art. As can be seen, many conventional aspects of kayak 40 are similar to kayak 10 and will thus be indicated by the same reference number. Unlike kayak 10, however, kayak 40 includes respective left and right thighstraps 42 and 44 which remain taut against hull 12 when not in use.

To achieve this desirable result, thighstrap 42 includes longitudinal elastic means which bias it towards the shortest distance between connection locations 28 and 30. Similarly, longitudinal elastic means bias thighstrap 44 toward the shortest distance between connection locations 32 and 34. In addition to reducing the likelihood of dangling thighstraps when kayak 40 capsizes, it can be seen that thighstraps 42 and 44 provide a more compact arrangement for kayak 40 when not in use.

Figure 3:
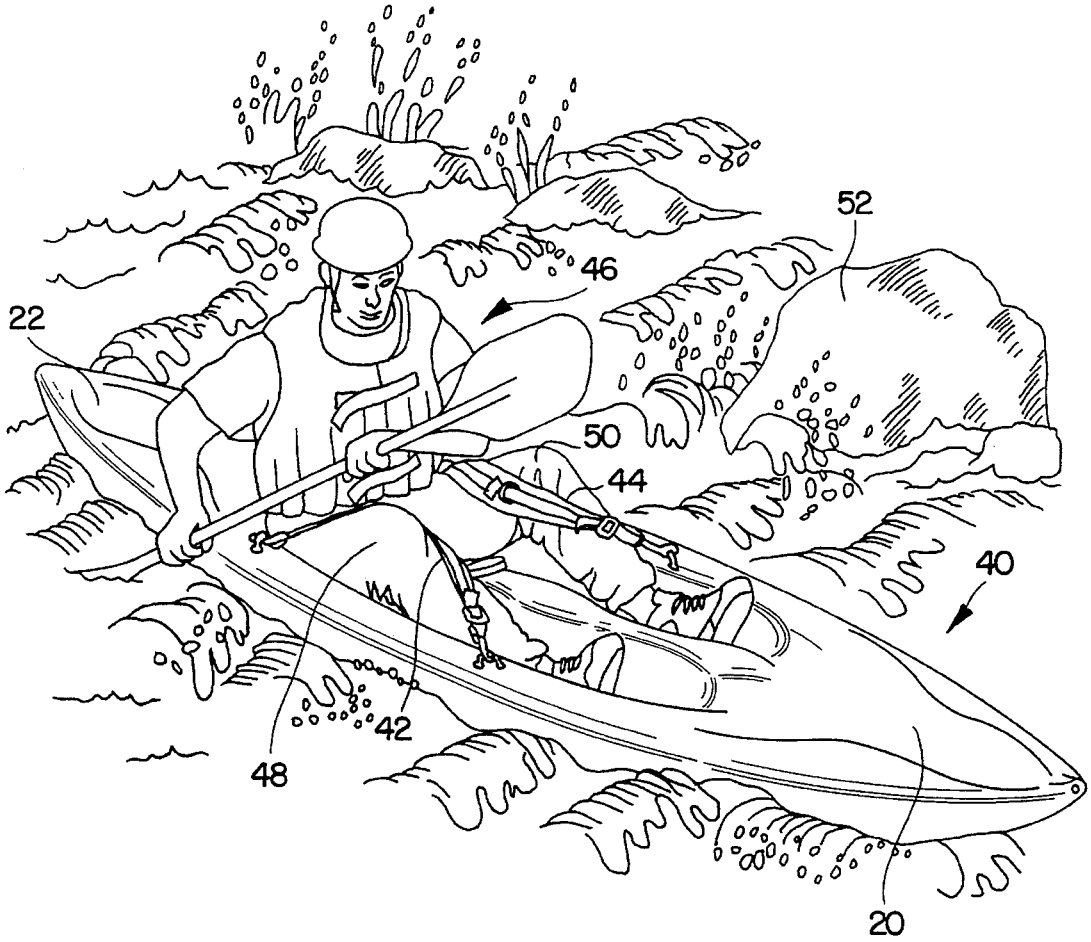
FIG. 3 is a perspective view of a paddler using an open cockpit kayak constructed according to the present invention.

Another significant advantage of kayak 40 may be most easily explained with reference to FIG. 3. In this illustration, a paddler (generally indicated at 46) is shown sitting in the cockpit of kayak 40 and negotiating whitewater rapids. As can be seen, thighstrap 42 is stretched around the right knee 48 of paddler 46, whereas thighstrap 44 is stretched around left knee 50.

It will be appreciated that a whitewater situation such as that illustrated will often require paddler 46 to aggressively steer and otherwise manipulate kayak 40. For example, it may be necessary for paddler 46 to quickly avoid an obstacle in the river, such as rock 52. The elastic means urge thighstraps 42 and 44 into a relatively constant engagement against respective knees 48 and 50. As a result, the need is largely eliminated for paddler 46 to take up slack in the thighstraps before positive control is achieved.

An exemplary construction of a presently preferred thighstrap assembly may be most easily explained with reference to FIGS. 4 and 5. While FIGS. 4 and 5 specifically illustrate the construction of thighstrap 42, it should be appreciated that the construction of thighstrap 44 would be substantially identical.

As shown, thighstrap 42 includes a pad 54 having a strap 56 attached thereto along a portion of its length. In this case, strap 56 is attached to pad 54 by stitching, although it should be understood that other suitable means of effecting such attachment may also be utilized. Strap 56 includes a free portion longitudinally extending from one end of pad 54. As shown, this free portion of strap 56 is folded back and extends through a slidable buckle 58 to form a loop 60. Strap 56 further defines a pair of smaller loops adjacent the portion thereof which is attached to pad 54. One of the smaller loops maintains therein a pair of adjacent rings which serve as a two-ring buckle 62.

Thighstrap 42 further includes a strap 66 secured via two-ring buckle 64, which permits its length to be varied as desired. Further, strap 66 longitudinally extends under guide loops 68 and 70 to a location external to pad 54. At its opposite end, a portion of strap 66 is fed back through a slidable buckle 72 to form a loop 74.

As shown, guide loops 68 and 70 are attached to pad 54 in a direction transverse the longitudinal extent of strap 66. As a result, guide loops 68 and 70 will tend to maintain strap 66 in proximity to pad 54 and in the correct orientation during extension and retraction.

Similar to the prior art discussed above, hooks 76 and 78 (FIG. 5) are provided to facilitate connection of thighstrap 42 to respective connection locations 28 and 30 on hull 12. Hook 76 is connected to loop 60 of strap 56, whereas 78 is connected to strap 66 as shown. Hooks 76 and 78 may be of the type having a slidable retaining bar extending across the mouth of the hook.

The elastic element utilized to longitudinally bias thighstrap 42 is configured as a single elastic cord. Specifically, a single elastic cord is threaded through one of smaller loops defined by strap 56. Two segments 80 and 82 of the elastic cord are thus produced, which extend under cross loops 68 and 70 in parallel with one another as shown. Segments 80 and 82 further extend through an eyelet 84 defined in strap 66 and are tied into a knot 86 on the back side of eyelet 84 in loop 74. Thus, the elastic cord is connected to strap 66.

Figure 4:
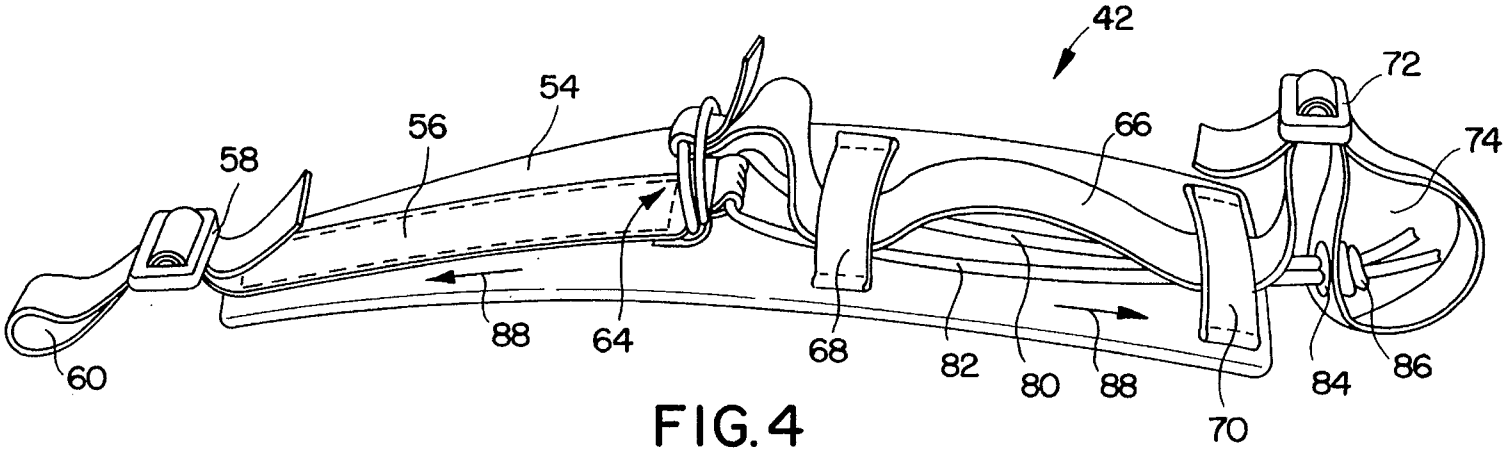
FIG. 4 is an enlarged view of a single thighstrap of the present invention when taut.

It will be appreciated that FIG. 4 illustrates a situation such as may occur when thighstrap 42 is not in use. In this case, the elastic cord retracts thighstrap 42 as shown by arrows 88 such that its overall length will tend to be defined by the distance between connection locations 28 and 30. As a result, thighstrap 42 lies taut against hull 12, as desired.

Figure 5:
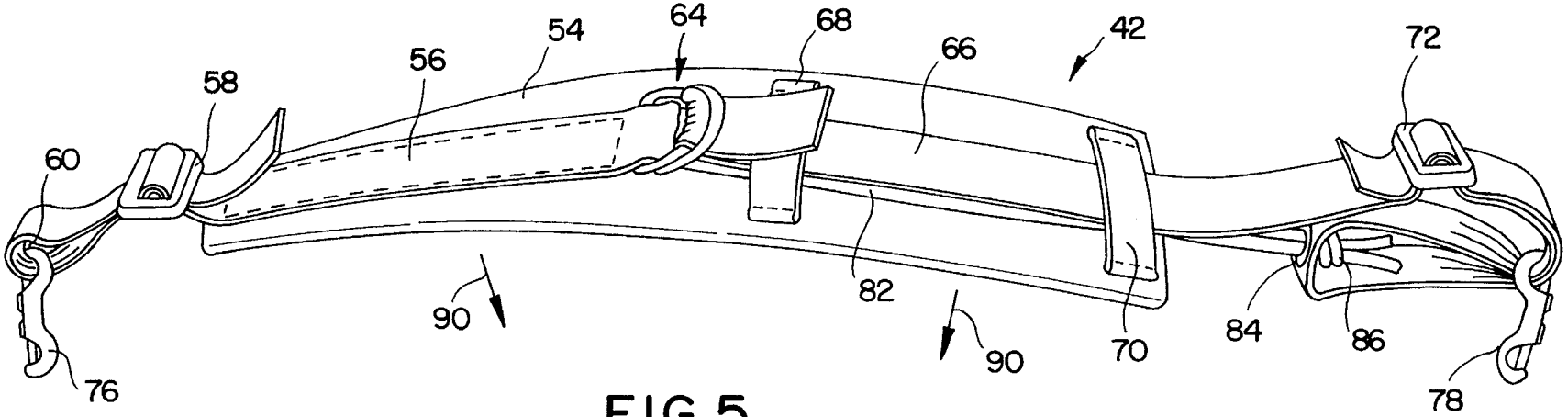
FIG. 5 is a view similar to FIG. 4 of a single thighstrap of the present invention when stretched.

FIG. 5 illustrates a situation when a paddler's knee is inserted under strap 42. In this case, thighstrap 42 it will expand outward. While the elastic cord will permit strap 42 to be stretched in this manner, its bias will continue to urge strap 42 to its retracted position. Thus, a force will be applied the paddler's knee as indicated by arrows 90. Due to this force, thighstrap 42 will tend to desirably remain in secure engagement against the knee.

While preferred embodiments of the invention have been shown and described herein, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A kayak comprising:

a hull extending in a longitudinal direction, said hull including a fore portion and an aft portion and defining a boat bottom;

said hull further defining a cockpit area configured to receive a paddler in a sitting position, said cockpit area located between said fore portion and said aft portion;

left and right thighstraps located along respective left and right side portions of said cockpit area;

said left and right thighstraps extending in the longitudinal direction of the hull, opposite ends of each of said left and right thighstraps being movably connected to said hull at respective fore and aft connection locations; and each of said thighstraps further including an elastic element maintaining said thigh strap in tension between said fore and aft connection locations such that each said thighstrap will generally remain taut against said hull when not is use and further apply tension to the paddler's knee when extending therearound.

2. A kayak as in claim 1, wherein said elastic element of each of said thigh straps comprises an elongated elastic element extending at least partially along the longitudinal length thereof.

3. A kayak as in claim 2, wherein said elongated elastic element includes an elastic cord.

4. A kayak as in claim 2, wherein said elongated elastic element extends from a location on said thighstrap adjacent said fore connection location to a first intermediate location on said thighstrap.

5. A kayak as in claim 4, wherein each of said thighstraps includes a pad extending at least partially along the length thereof.

6. A kayak as in claim 5, wherein said pad extends from a location on said thigh strap adjacent said aft connection location to a second intermediate location on said thighstrap.

7. A kayak as in claim 6, wherein said first intermediate location is located between said fore connection location and said second intermediate location such that said elongated elastic element and said pad overlap over a portion of the length of said thighstrap.

8. A kayak as in claim 1, wherein each of said thigh straps includes a thigh engaging element extending at least partially along the length thereof.

9. A kayak as in claim 8, wherein said thigh engaging element comprises an elongated pad.

10. A kayak as in claim 8, wherein said thigh engaging element extends from a location on said thighstrap adjacent said aft connection location to an intermediate location on said thigh strap.

11. A kayak thigh strap assembly comprising:

a thigh engaging element having a first end and a second end;

a first strap constructed of elongated strap material, said first strap having an attached portion attached to said thigh engaging element and further having a free portion longitudinally extending from said first end of said thigh engaging element;

a second strap constructed of elongated strap material, said second strap having a secured portion operatively secured at a location on said thigh engaging element and further having a free portion longitudinally extending from said second end of said thigh engaging element;

an elastic element connected to said second strap to apply a force thereto tending to bias said second strap against longitudinal extension thereof; and first and second hooking elements for connecting respective ends of said thigh strap assembly to a hull of a kayak, said first hooking element connected to said free portion of said first strap and said second hooking element connected to said free portion of said second strap.

12. A kayak thigh strap assembly as in claim 11, including at least one guide element attached to said thigh engaging element through which said second strap extends to guide said second strap during longitudinal movement thereof.

13. A kayak thigh strap assembly as in claim 11, wherein said secured portion of said second strap is connected to said first strap via a two-ring buckle such that a length of said second strap may be adjusted.

14. A kayak thigh strap assembly comprising:

a thigh engaging element having a first end and a second end;

a first strap constructed of elongated strap material, said first strap having an attached portion attached to said thigh engaging element and further having a free portion longitudinally extending from said first end of said thigh engaging element;

a second trap constructed of elongated strap material, said second strap having a secured portion operatively secured at a location on said thigh engaging element and further having a free portion longitudinally extend from said second end of said thigh engaging element;

an elastic element connected to said second strap to apply a force thereto tending to bias said second strap against longitudinal extension thereof, wherein said elastic element includes an elastic cord; and first and second hooking elements for connecting respective ends of said thigh strap assembly to a hull of a kayak, said first hooking element connected to said free portion of said first strap an said second hooking element connected to said free portion of said second strap.

15. A kayak thigh strap assembly as in claim 14, wherein said elastic element includes at least two elastic cord segments extending substantially in parallel.

16. A kayak thigh strap assembly as in claim 14, wherein said elastic element includes an elastic cord threaded through a loop in said first strap and having two segments extending substantially in parallel back to the location of connection to said second strap portion.

17. A kayak thigh strap assembly as in claim 16, wherein said elastic cord extends through an eyelet defined in said second strap portion and is knotted to effect connection thereto.

* * * * *

UNITED STATES PATENT AND TRADEMARK OFFICE

CERTIFICATE OF CORRECTION

PATENT NO. : 5,493,982

DATED : February 27, 1996

INVENTOR(S) : Carpenter, et al.

It is certified that error appears in the above-indentified patent and that said Letters Patent is hereby corrected as shown below:

In the Claims:

Column 6, claim 14, line 66, change "trap" to --strap--.
Column 7, claim 14, line 2, change "extend" to --extending--.
Column 7, claim 14, line 11, change "an" to --and--.

Signed and Sealed this

Ninth Day of July, 1996

*Attest:*

Bruce Lehman

BRUCE LEHMAN

*Attesting Officer*

*Commissioner of Patents and Trademarks*